United States Patent [19]

Petrie

[11] Patent Number: 4,523,348

[45] Date of Patent: Jun. 18, 1985

[54] NURSE'S MITT

[76] Inventor: Colleen Y. Petrie, Box 267, Palatine Bridge, N.Y. 13428

[21] Appl. No.: 605,224

[22] Filed: Apr. 30, 1984

[51] Int. Cl.[3] ..... A47K 7/02

[52] U.S. Cl. ..... 15/227; 2/158

[58] Field of Search ..... 15/227, 104.94; 2/158

[56] References Cited

U.S. PATENT DOCUMENTS

| | | | |
|---|---|---|---|
| 632,547 | 9/1899 | Barth | 2/158 |
| 2,431,433 | 11/1947 | Solakian et al. | 15/227 |
| 3,327,320 | 6/1967 | Forsyth | 15/227 |
| 3,711,889 | 1/1973 | Jennings | 15/227 |
| 4,104,740 | 8/1978 | Rinehart | 2/158 |

FOREIGN PATENT DOCUMENTS

| | | | |
|---|---|---|---|
| 261274 | 6/1960 | Australia | 15/227 |
| 399407 | 10/1933 | United Kingdom | 15/227 |

*Primary Examiner*—Edward L. Roberts

*Attorney, Agent, or Firm*—Walter F. Wessendorf, Jr.

[57] ABSTRACT

Disclosed is a nurse's mitt for washing purposes having similarly configured palm and back portions joined together at their common tops and sides, having an elastic wrist portion for retention on the wrist and having elastic finger loops on the interior mid portion of the palm portion to retain the proximal phalanges of the index, middle and ring fingers inserted therein.

1 Claim, 1 Drawing Figure

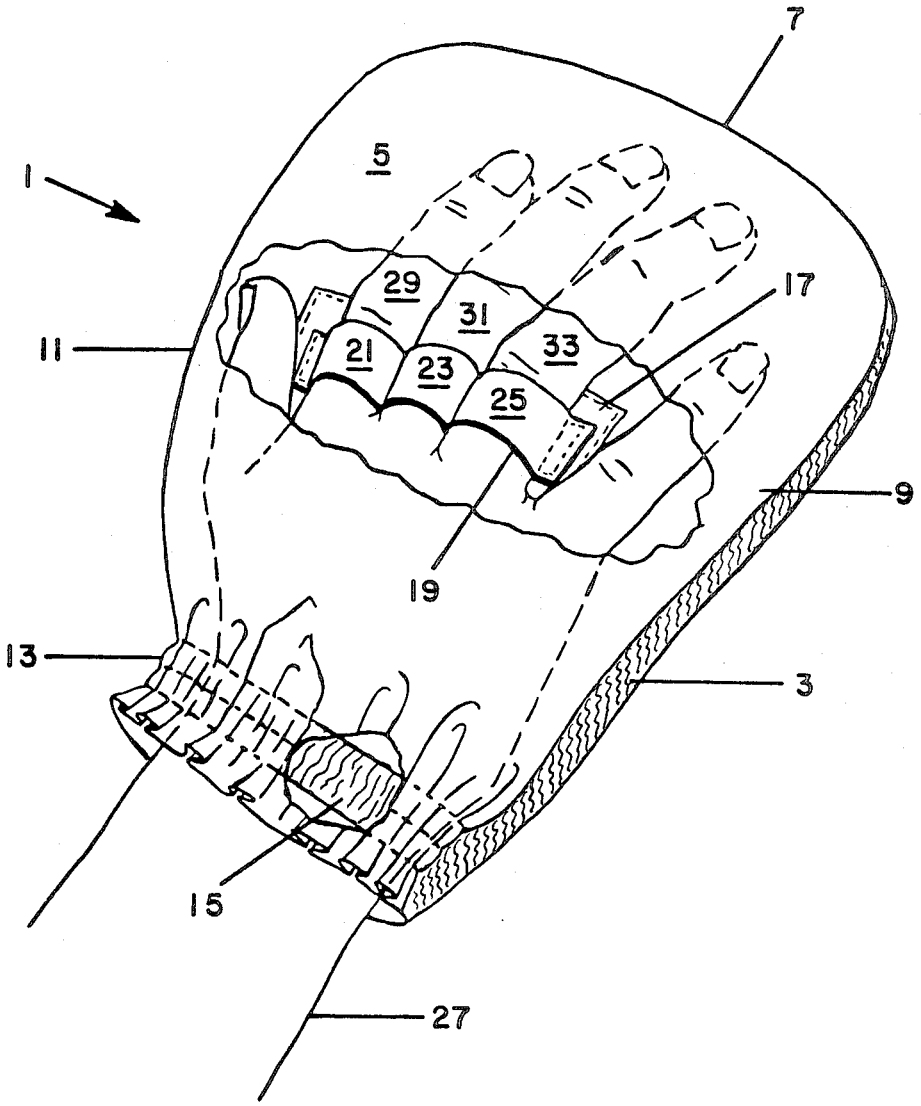
7
5
1
29
31
17
11
21
23
33
25
9
19
13
3
15
27

NURSE'S MITT

BACKGROUND OF THE INVENTION

1. Technical Field

This invention relates to a nurse's mitt to be used in place of a conventional washcloth to cleanse the skin, refresh and stimulate circulation.

2. Background

While caring for the hospitalized or nursing home patient, invalid or elderly in the home, baby or child, the conventional washcloth is inefficient and awkward. A washcloth necessitates the use of both hands to apply soap and rinse material. Thus, if the patient has to be turned and held on his side to wash his back, an extra nurse may be necessary to hold this obese, paralyzed or otherwise debilitated patient in position. A washcloth has to be folded, wadded in the hand or folded around the hand. This makes the washcloth difficult to control and lacks uniformity of pressure on the patient's skin. In the situation when a patient's buttocks or perineal area needs cleansing while he is in a standing position, two nurses are oftentimes needed: one to give support and the other to wash the patient. In a limited space, such as a bathroom, the use of a hard-to-handle washcloth is awkward. The awkwardness of this situation is magnified if the area to be washed cannot be seen due to the nurse's position in relation to such patient. If, while being washed, such standing patient begins to fall and needs immediate support from the nurse, a time delay while the nurse discards the washcloth may be critical. For the arthritic patient or a patient afflicted with any of the number of musculoskeletal disorders, it is difficult for such patient to hold his washcloth making self-care for such patient difficult or impossible and necessitating more dependence on others.

Accordingly, the object of this invention to provide a nurse's mitt which will contribute to the solution of the discussed problems of the art.

SUMMARY OF THE INVENTION

In accordance with the invention, there is provided a terrycloth bathing mitt which will more efficiently and easily facilitate the bathing process and save time. Instead of two nurses being necessary to wash a patient, one nurse can hold the patient with one hand, and her soap or rinse mitt secured to her other hand being in a nearby basin. The nurse's bathing mitt of this invention is easier to control for the reason that it is already secured in the nurse's hand. The pressure of the nurse's mitt is flat and uniform flowing smoothly over the patient's skin which not only contributes to such patient's comfort during bathing and makes it easier to wash difficult to reach areas, but also affords the uniformity of pressure that is so important when washing the frail skin of the elderly patient which, in many cases, is paper-thin. Hence, tender, sore or healing areas can easily be avoided with control of the direction of the nurse's mitt. In such situation when a patient's buttocks or perineal area needs cleansing, only one nurse need attend to such task because by using the nurse's mitt her other hand is free to support such patient. Difficult to see and reach areas can be more easily cleansed with the nurse's outstretched mitt-covered hand. The ease in washing which the nurse's mitt affords saves time and time is important if the patient can only stand for a limited time. If such standing patient begins to fall while being washed, the nurse can provide immediate support because she is wearing, not holding, the washing material. The nurse's mitt of this invention will also add to the nurse's gripping power especially when the patient is wet and slippery. In the situation of the patient afflicted with disorders making it difficult to hold a washcloth, self-care can be enhanced because such patient can wear the nurse's mitt to wash himself thereby achieving a sense of satisfaction, self-worth, dignity and independence not possible before.

Other benefits are realized in utilizing the nurse's mitt of this invention. Two-handed washing is possible by wearing a nurse's mitt on each hand with the mitts serving the concomitant purpose as grips while the patient is in the tub or shower. Two-handed washing and grips make washing newborns easier as the baby thrashes in the tub. Moreover, flaccid newborns require added support. Children will enjoy bathing themselves with the nurse's mitt. The child with a short attention span will not forget to finish bathing when the nurse's mitt on his hand serves as a reminder. The joy of using this nurse's mitt lowers stress and frustration as well for home-care givers, patients themselves and mothers by more efficiently getting the job done.

In addition to the obvious superiority of this terrycloth bathing mitt, its design is simple, easy to manufacture, durable and able to withstand repeated washings.

BRIEF DESCRIPTION OF THE DRAWINGS

This object and other objects of the invention should be discerned and appreciated from the detailed description taken in conjunction with the drawings in which the drawing FIGURE shows the nurse's mitt being worn on the right hand.

DESCRIPTION OF THE PREFERRED EMBODIMENT

In the drawing FIGURE, reference numeral 1 generally refers to the invention of the nurse's mitt that can be interchangeably used and worn on either hand.

The nurse's mitt 1 comprises a palm portion 3 of terrycloth material suitably affixed, such as being sewn thereto, to a back portion 5 of cotton broadcloth material at their common tops 7 and sides 9 and 11. Both palm and back portions 3 and 5 are of the same configuration, as shown shown. The wrist portion 13 of the back portion 5 is gathered, as shown, via a strip of elastic material 15 sewn to the interior side of wrist portion 13. A rectangular-shaped blank of material 17 is sewn to the interior mid portion of the palm portion 3, as shown. A strip of elastic material 19 is suitably sewn to blank 17, as shown, to form finger loops 21, 23 and 25, as shown.

The nurse's mitt 1 is shown being used and worn on the right hand 27 with the proximal phalanges of the index, middle and ring fingers 29, 31 and 33 being inserted in retentive relationship within such respective finger loops 21, 23 and 25. The elastic material 15 in the wrist portion 13 also assists in providing retention on the hand.

The terrycloth material utilized for the palm portion 3 or facing surface has a known cleaning surface quality and provides a better gripping surface.

With the index, middle and ring fingers inserted in retentive relationship in the finger loops, there is total control at all times because the nurse's mitt remains worn on the hand and can not leave such hand.

To render the palm portion 3 flat, uniform and smooth for flowing smoothly over the patient's skin, the nurse simply spreads her fingers and thumb apart. To conform the palm portion 3 to a particular surface being washed, the nurse simply contours her hand and fingers to such surface which in turn correspondingly contours such palm portion 3. For gripping purposes, the hand and fingers are clenched upon the object to be gripped to correspondingly conform and contour such palm portion 3.

Having thusly described my invention, I claim:

1. A nurse's mitt of cloth-like material for washing purposes, said nurse's mitt comprising a palm portion, a back portion, a wrist portion having first elastic means, said palm portion having second elastic means, said palm and back portions being similarly configured, said palm and back portions having common tops and sides, said palm and back portions being joined together at their respective common tops and sides, said wrist portion having said first elastic means for retention of said nurse's mitt on the wrist of a human operator, said palm portion having an interior mid portion, said second elastic means being suitably affixed to said interior mid portion to define finger loops for insertion in and retention by said finger loops of the proximal phalanges of the index, middle and ring fingers of the human operator's hand.

* * * * *